United States Patent [19]

Zwiegel

[11] Patent Number: 5,031,696

[45] Date of Patent: Jul. 16, 1991

[54] CASING HANGER AND SEAL

[75] Inventor: John M. Zwiegel, Houston, Tex.

[73] Assignee: Cooper Industries, Inc., Houston, Tex.

[21] Appl. No.: 556,891

[22] Filed: Jul. 23, 1990

[51] Int. Cl.[5] ..... E21B 33/00

[52] U.S. Cl. ..... 166/86; 166/88; 166/207; 285/142; 285/146; 285/147

[58] Field of Search ..... 166/207, 209, 88, 96, 166/97.5, 98, 216, 217, 368; 285/140, 142, 144, 146, 147

[56] References Cited

U.S. PATENT DOCUMENTS

| | | | |
|---|---|---|---|
| 1,727,583 | 9/1929 | Cant | 166/88 |
| 1,728,432 | 9/1929 | Mildren | 166/88 |
| 1,825,774 | 10/1931 | Boynton | 166/88 |
| 2,610,689 | 9/1952 | Eckel | 285/147 |
| 2,683,045 | 7/1954 | Brooks | 285/146 |
| 2,712,455 | 7/1955 | Neilon | 166/88 |
| 3,134,610 | 5/1964 | Musolf | 166/88 |
| 3,204,695 | 9/1965 | Murray, Jr. | 166/88 |
| 3,255,823 | 6/1966 | Barton | 166/88 |
| 3,287,035 | 11/1966 | Greenwood | 166/88 |
| 4,306,742 | 12/1981 | Hardcastle | 285/147 |

*Primary Examiner*—Ramon S. Britts
*Assistant Examiner*—Roger J. Schoeppel
*Attorney, Agent, or Firm*—William E. Shull; David A. Rose; Ned L. Conley

[57] ABSTRACT

An improved casing hanger and seal assembly includes a split seal ring disposed between annular plates on a support shoulder in a wellhead. A plurality of floating pedestals are received within the seal ring. A slip and bowl assembly is mounted over the seal ring in the head, and when loaded by the casing weight provides the force to energize the seal ring to seal the casing and head. The floating pedestals provide stops to limit seal energization to a predetermined amount, and are movable with the seal ring to assist in distributing stress equally across the cross-section of the seal ring.

18 Claims, 7 Drawing Sheets

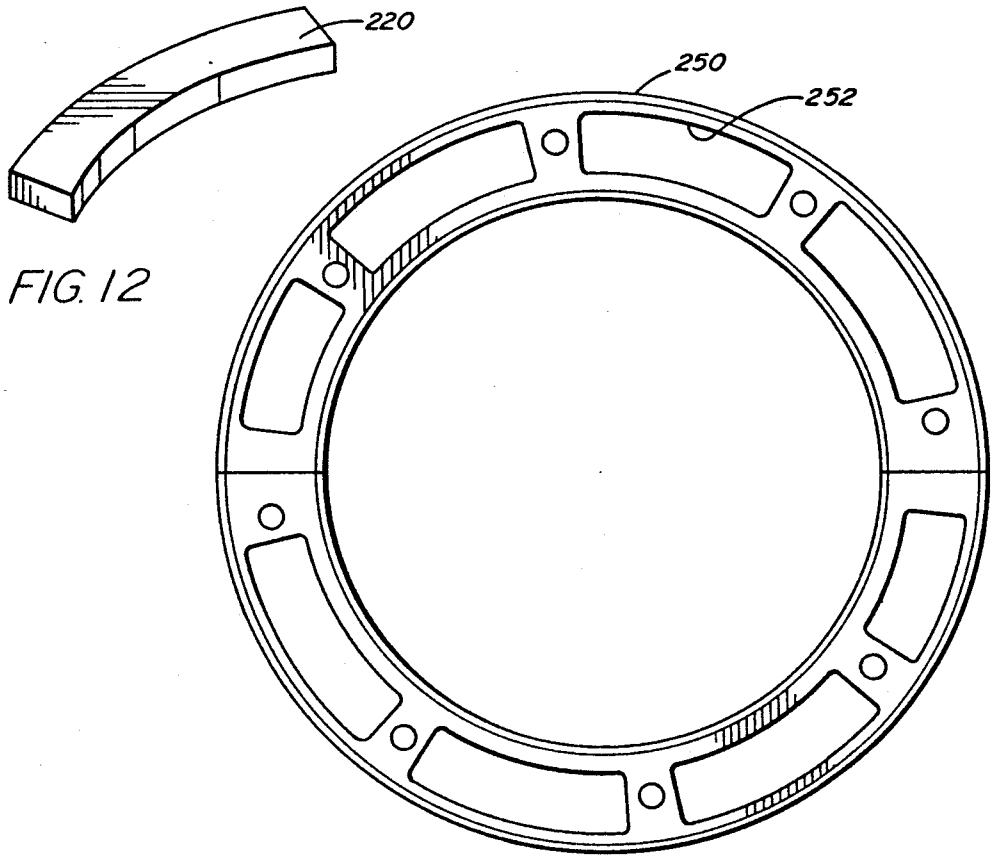
FIG. 12
FIG. 13
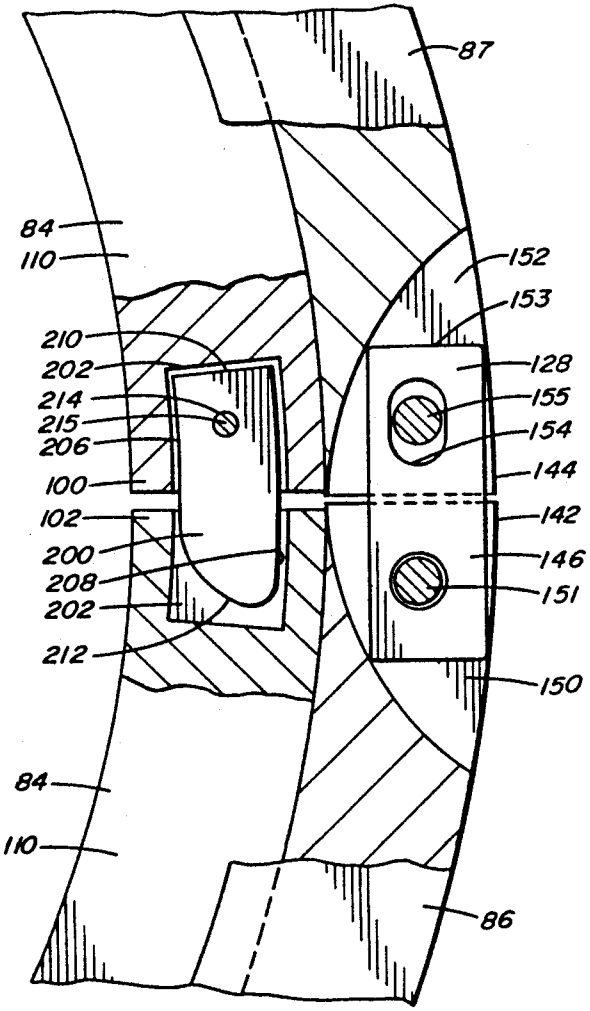
FIG. 11

CASING HANGER AND SEAL

BACKGROUND OF THE INVENTION

The present invention relates to the field of oil and gas production equipment, and more particularly to the field of wellhead equipment. More particularly still, the present invention relates to the field of casing hangers and seal assemblies for locating and sealing casing in a wellhead.

Local, state, federal, and foreign laws and regulations commonly require that the sidewalls of oil and gas wells be sealed to prevent the migration of oil and gas from the reservoir area into aquifers and adjacent soil. In order to isolate the wellbore from the surrounding soil and prevent collapse from formation pressures, casing is inserted into the well and cemented to the walls of the wellbore. The casing is typically comprised of joints of hardened steel tube, a string of which in a wellbore may weigh a million pounds or more. The casing strings must be supported in the wellbore to prevent them from collapsing into the well. Further, the upper end of the casing must be sealed to prevent well fluids from escaping past the end of the casing and into the atmosphere or soil. To perform these functions, wellhead assemblies have been devised which can support and seal several casing strings in annular alignment in the wellbore.

In a typical well, a tool known as a hole opener opens a shallow bore to start the well and a string of conductor pipe is then driven or drilled into the earth. The hole for the surface casing is drilled through the conductor pipe. The surface casing is run into the well and cemented in place, and a landing base may be installed at the upper end of the conductor pipe. A head is installed on top of the surface casing, on the landing base, if present. Successively smaller diameter and deeper holes are then drilled for one or more successively smaller diameter but longer intermediate casing strings, down to the production casing. These casings are in turn run into the wellbore, cemented, and suspended in the wellhead. The next smaller size casing from the surface casing is typically suspended from hanger equipment in a casing head, and successively smaller casing strings are typically suspended from hanger equipment in separate spools or heads installed on top of the previous casing heads. Then, after all casings are in place, a similar procedure is followed for the tubing head and tubing string or strings. Each time a new one of the separate heads is installed the blowout preventer equipment, which is usually in place during drilling operations, is removed. During the time the blowout preventer equipment is removed, the hole is exposed and unprotected from blowouts until the new head is installed and the blowout preventer stack reinstalled or replaced. Therefore, it is important that installation of the several heads comprising the wellhead assembly be effected as rapidly as possible.

Each head of the wellhead assembly comprises an annular member having a load shoulder or taper therein which engages a bowl and/or slip system to engage the casing string and support it in the wellbore. A seal assembly is also employed to seal the annular space between the casing and the head. One of three head profiles is typically employed to hang the casing string in the wellbore: a taper; a multiple shoulder; or a single shoulder. In each design slips engage the upper end of the casing string and are actuated radially inwardly when pulled down an angled surface in the head or the bowl by the casing. When equilibrium is reached the tension on the casing will be transferred via the slips and other hanger components into the head without adverse effects on the casing.

In practice, the hanger assembly is wrapped around the casing which protrudes out of the head or the blowout preventer stack. The assemblies are then lowered or dropped through the blowout preventer (if present) into the head. The casing is pulled upward in the well, which stretches the casing. The force pulling on the casing is then incrementally reduced, tending to reduce this stretch. At this point, the slips, which are in contact with the casing, are pulled into the bowl or head. The movement into the taper of the bowl or head produces a radially inward actuation of the slips, and a circumferential gripping of the casing by the slips and the slips by the bowl or head. The slips, having been radially actuated by the downward vertical movement, resist further movement of the casing and hold it in stretched tensional equilibrium in the wellbore. The action of the slip and bowl system causes a seal assembly located adjacent thereto to compress, forcing the seal to radially engage the annularly opposed casing and head surfaces.

The tapered head casing hanger with top seal employs a head having a tapered profile which interferingly engages a set of slips which in turn support the casing string. A seal ring assembly is located over the slips to form a seal between the outside diameter of the casing string and the inside diameter of the head above the tapered area when the seal is actuated. The hangers include slips (inner component) and a bowl (outer component), each comprised of a number of sections placed end-to-end to form an annular structure. The slip assembly is generally cylindrical, and includes a minor diameter lower portion, a major diameter upper portion, and a frustoconical-shaped slip shoulder on its outer diametral surface connecting the minor diameter and major diameter portions. The inner diametral surface of the slip assembly includes a plurality of radially inwardly extending teeth which engage the casing. The bowl, having a frustoconical-shaped shoulder on its inner diametral surface, a frustoconical-shaped lower outer surface, and a flat upper face, is disposed between the slip assembly and the head. The bowl terminates on its upper end in a flat annular ledge, upon which a seal assembly is disposed. The seal assembly is a sandwich seal, having opposed upper and lower plate sections and a seal element located therebetween. A plurality of bolts or cap screws are anchored in the upper plate and pass freely through the lower plate and seal element, and are threaded into the slips. As the casing and slips are moved into the head, the slips engage the bowl, forcing the bowl further into engagement with the head. The bowl will ultimately seat against the tapered portion of the head and the slips will move downwardly into the bowl until the slip shoulder of the slip assembly engages the frustoconical-shaped shoulder on the inner surface of the bowl. As this occurs, the lower plate of the seal assembly will bear on the flat upper face of the bowl as the upper plate is pulled down via the bolts or cap screws anchored in the upper plate and attached to the slips. As a result, the seal element compresses vertically and expands radially into engagement with the casing and head to seal the annular area therebetween. The tapered head top seal casing hanger has a significant disadvantage. When pressuring the annulus from the bottom (slip side), the seal can pull the hanger upwardly out of the tapered portion of the head, causing the slips to disengage from the casing and permitting the casing to slip and buckle in the well.

A multiple shoulder casing hanger with automatic seal employs a head having an upper radial shoulder upon which a sandwich seal is seated, and a slip and bowl system therebelow for holding the casing string and energizing the seal. The head includes a lower minor diameter portion and an upper major includes a lower minor diameter portion and an upper major diameter portion interconnected by an upwardly facing frustoconical support shoulder. A bowl, having a major diameter, a minor diameter, and a downwardly facing shoulder for mating with the support shoulder of the head, is disposed below the seal. The seal may be bolted to the bowl in a manner like that referred to above in connection with the tapered head casing hanger with top seal. The inner diameter of the bowl comprises a continuous, upwardly facing frustoconical surface. A set of slips, in the form of a circular wedge, has a gripping face in contact with the casing string and a second gripping face in engagement with the continuous frustoconical surface of the bowl. The bowl is sized to permit the bowl to actuate or travel downwardly as the casing string is engaged by the slips, thus energizing the seal. The support shoulder in the head forms a stop to limit the downward travel of the bowl, thus limiting the linear actuation of the seal. This allows part of the weight of the casing string to be carried by the seal assembly and its radial support shoulder on the head, and part on the frustoconical support shoulder between the bowl and the head.

Because multiple shoulders are employed in the head, the multiple shouldered hanger requires high tolerance machining of the head to properly locate the bowl stop shoulder and seal support shoulder relative to one another. Loss of shoulder surface area due to tolerancing can cause problems in holding applied loads, and these problems become critical for higher hanging loads. In addition, no means exists to seal below the slips and isolate pressure from the slip area. Moreover, when higher pressure rated heads are used, profile changes in the heads require profile changes on the outside of the hangers forcing higher inventory requirements.

A single shoulder casing with automatic seal employs a head having a radial shoulder which accepts the load of the seal and the pipe weight. The assembly includes a set of wedge-shaped slips which engage a bowl disposed in a head, and a seal disposed in annular sections on either radial side of a pedestal mounted below the bowl and retained on an annular ledge in the head. As the slip is forced downwardly in response to casing loading, the base of the bowl, which straddles the pedestal, squeezes the seal. To prevent over-energization of the seal, the bowl includes a slot which is shallower than the height of the pedestal and into which the pedestal projects. Thus, the bowl ultimately rests on the pedestal at complete seal actuation. As load is applied to the seal from the weight of the casing string, the seal elements are squeezed and expand radially to fill the gap between the head and the pedestal, and the pedestal and the casing. Large tolerance ranges for the outer diametral surface of the casing can create from very high to very low sealing loads, given that the inner seal does not communicate with the outer seal. This can create problems ranging from overstressing the casing to not producing a good seal and often leads to uneven compression loads between inner and outer seal.

The single shoulder hanger may have a seal without any support in the seal element. This would leave the seal holding the hanging weight. Overstressing of the seal and the pipe could lead to pipe collapse or excessive seal extrusion.

Thus, the prior art casing hangers have several deficiencies. For the tapered head style, perhaps the greatest technical shortcoming is the possibility of dropping pipe when pressured from below. This can cause severe damage to the well, and to the pipe, the rig, or other hardware, and can be extremely hazardous to personnel. Obtaining and maintaining adequate shoulder area is perhaps the greatest technical problem associated with the multiple shoulder head style. With higher hanging loads and pressures special heads and hangers are required to keep deformation of head and hanger to acceptable levels. Many consider the major technical problem with the present single shoulder style to be achieving and maintaining proper seal loading. Without a stop, the seal can be overpressured when required to support hanging weight. When the prior art annular pedestal is employed, two seals are required. The inner seal must cover a very wide range due to the amount of tolerance on the casing. As a result, there may be a very high stress in one seal, and a very low stress in the other seal, with no adequate means of equalizing them.

An economic burden common to all of the foregoing designs is the need for high part count. This produces a need for higher inventory count, and as a result, higher costs.

SUMMARY OF THE INVENTION

The present invention is an improved casing hanger and seal assembly with floating load bearing stops in the seal element. A split annular seal element is employed which, when assembled, forms an annular seal member which seals both the casing and the head. The seal element includes a plurality of load bearing stops or pedestals disposed therewithin. The seal element is supported between upper and lower retainer plates, the lower of which seats upon a shoulder in the head. The pedestals are actuable with respect to the seal element, and with respect to the upper and lower seal retainer plates. A slip and bowl assembly is disposed over the seal assembly to engage and hang the casing and energize the seal assembly by transferring a portion of the weight of the casing onto the seal, thereby causing radial expansion of the outside diameter and radial contraction of the inner diameter of the seal to seal the head and casing surfaces. The pedestals, which have floated with the movement of the seal element, then accept the balance of the load so as not to over-compress the seals. The head includes only a single load shoulder, on which the lower retainer plate seats, to actuate both the seal assembly and slips. The total force from hanging of the casing is transmitted through the seal assembly onto the load shoulder in the head. Placement of the seal assembly under the bowl, thus taking all the load through the seal assembly, avoids the possibility of picking up on the slips and dropping the casing through pressuring from below. Also, with the present invention there is no need to machine a taper in the head, or to rely on bolts or cap screws to keep the seal assembly energized.

Freedom of the pedestals to float with the seal assures a proper seal between the casing and head by evenly distributing stress across the seal element and ensuring that the seal element expansion and stress is even on both its radially inner and radially outer portions. This stress can be controlled by the travel limit produced by the pedestal length. The use of a single load shoulder in the head requires only a minimum of machining. Loss of bearing area to extra tolerances, such as encountered with the multiple landing shoulder approach, is eliminated. The single shoulder and hanger configuration also enables parts stocks to be held to a minimum. Further, the hanger assembly includes a slip retainer lip, which retains the slips in the bowl if the casing collapses, thereby retaining the casing in the head and preventing the loss thereof into the wellbore. These and other objects and advantages of the invention will become apparent from the following description of the preferred embodiment when read in conjunction with reference to the following drawings, wherein:

BRIEF DESCRIPTION OF THE DRAWINGS

FIG. 11 is a detail view of the bowl latch and slip support assemblies the casing hanger of FIG. 1.

FIG. 12 is a view of an alternative pedestal configuration of the present invention.

FIG. 13 is a top view of an alternative seal element configuration for use with the alternative pedestal of FIG. 12.

DESCRIPTION OF THE PREFERRED EMBODIMENT

Figure 1:
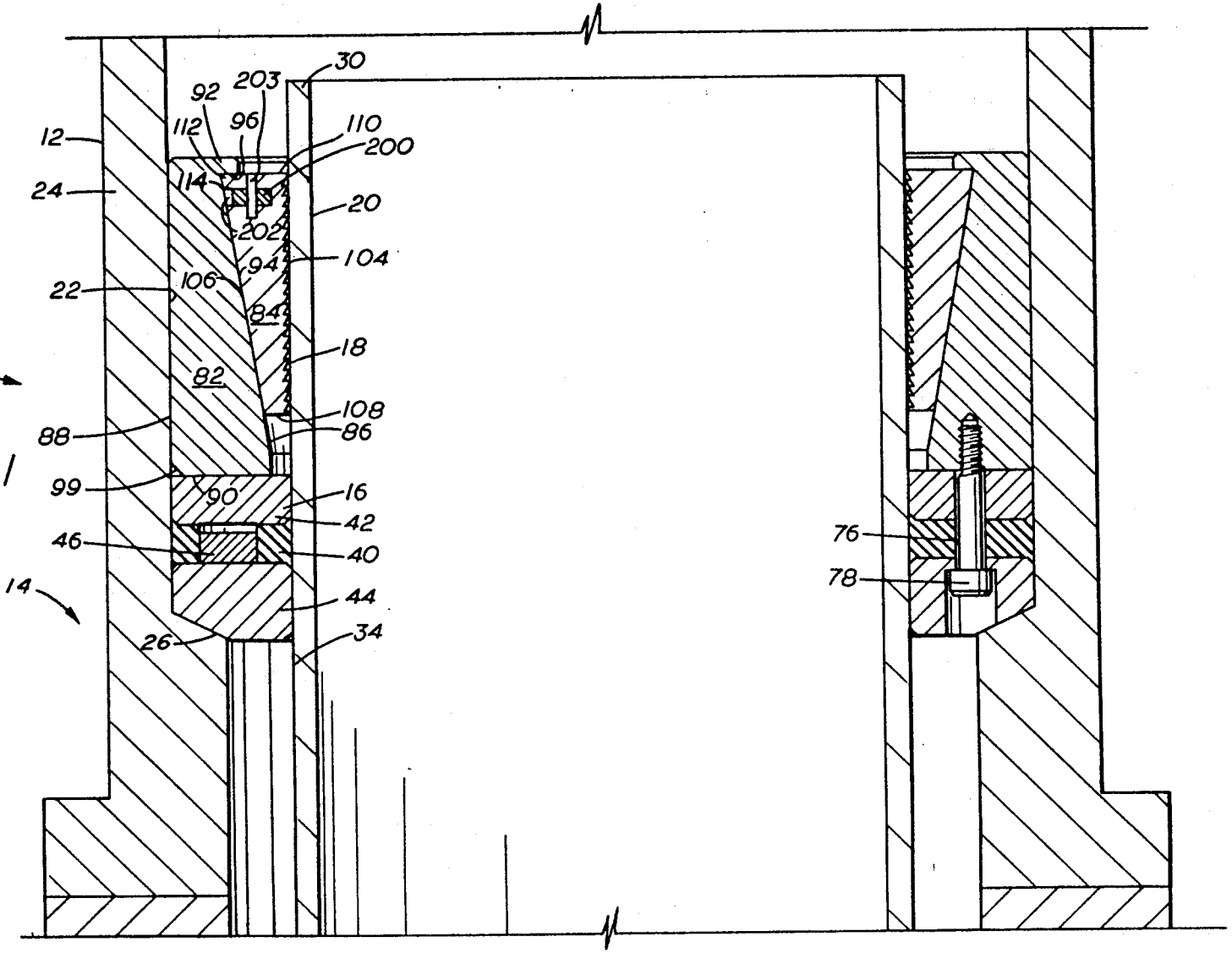
FIG. 1 is a cross-sectional view of a portion of a wellhead including the casing hanger and seal of the present invention.
Figure 2:
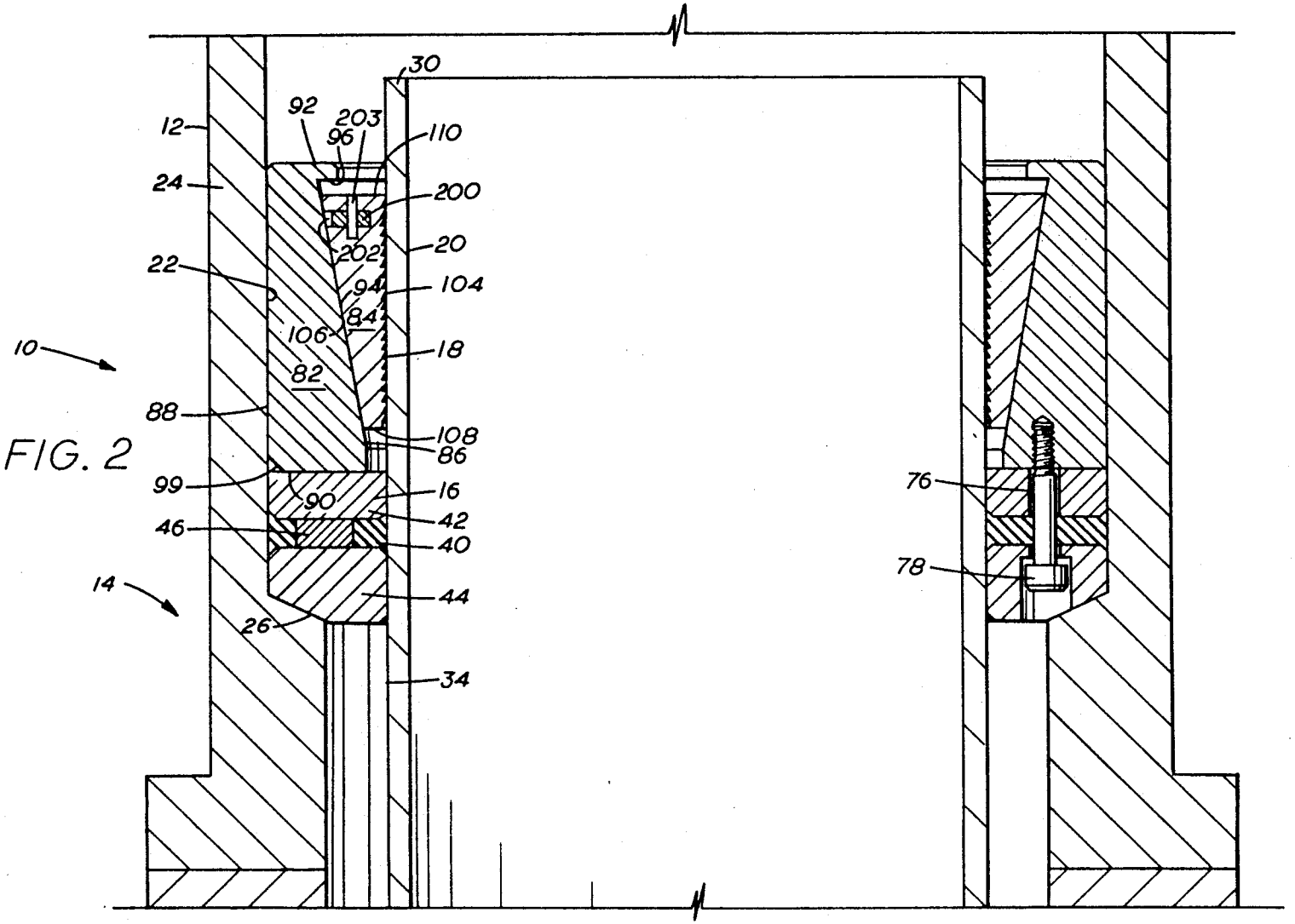
FIG. 2 is a cross-sectional view of a portion of a wellhead including the casing hanger and seal of the present invention with the seal energized.

Referring to FIGS. 1 and 2, the casing hanger and seal assembly of the present invention is indicated generally at 10 and is disposed in a head 12 of a wellhead 14. The casing hanger and seal assembly 10 of the present invention includes a seal assembly 16 disposed within the head 12 adjacent its lower end, and a slip and bowl assembly 18 disposed over the seal assembly 16 for engaging casing 20 and energizing seal assembly 16. Head 12 generally comprises an annular cylindrical machined member having an inner diametral surface 22 extending from its upper end portion 24, and a radially inwardly extending retaining shoulder 26 near its lower end portion. The diameter of inner diametral surface 22 may be varied to receive various diameter slip and bowl assemblies 18 and seal assemblies 16. The inner diameter of bore 22 is preferably only slightly larger than the outer diameter of slip and bowl assembly 18 and seal assembly 16. Seal assembly 16, with slip and bowl assembly 18 located thereon, is lowered into bore 22 such that retaining shoulder 26 supports seal assembly 16 and slip and bowl assembly 18 in head 12. Head 12 may be disposed, for example, on a landing base around a conductor pipe, or on the upper end of a larger diameter casing head. Casing 20 is disposed through head 12 such that the upper end 30 of the casing is located adjacent slip and bowl assembly 18, and the remainder of the casing is hung below head 12 and extends into the wellbore.

To retain, or hang, casing 20 in head 12, casing 20 is typically lowered into the well through a blowout preventer until its upper end 30 is located about three to six inches above the upper end portion 24 of head 12. Slip and bowl assembly 18, having seal assembly 16 mounted thereon, is then mounted over casing 20, and these assemblies are lowered into head 12 until seal assembly 16 seats upon shoulder 26. Casing 20 is then pulled up by the derrick, which has the effect of stretching the casing. The force stretching casing 20 is then incrementally decreased, which causes slip and bowl assembly 18 to engage casing 20. The weight of casing 20, transferred through the slip and bowl assembly 18, compresses seal assembly 16 such that the seal element expands radially outwardly and inwardly to engage both the bore 22 of head 12 and the outer diametral surface of casing 20. Thus, the casing annulus 34 formed in the space between the casing 20 and head 12 below seal assembly 16 is sealed off from the area above seal assembly 16.

Figure 5:
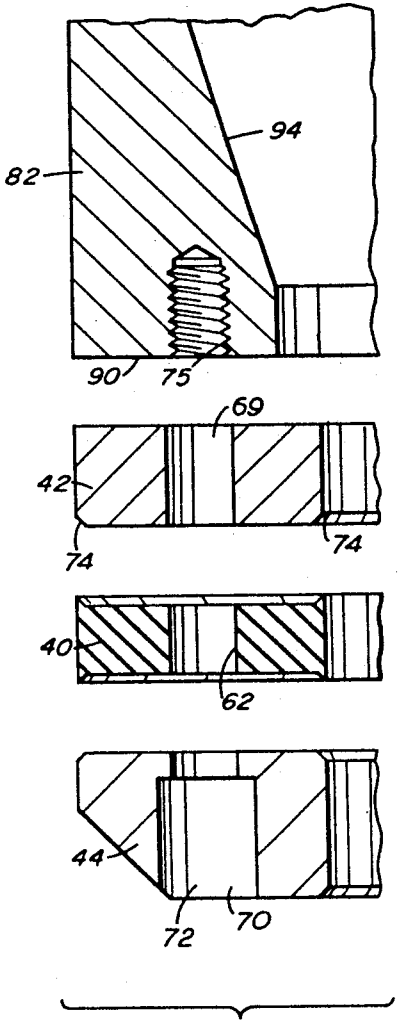
FIG. 5 is another exploded cross-sectional view of the seal assembly and a portion of the bowl assembly used with the improved casing hanger of FIG. 1.
Figure 4:
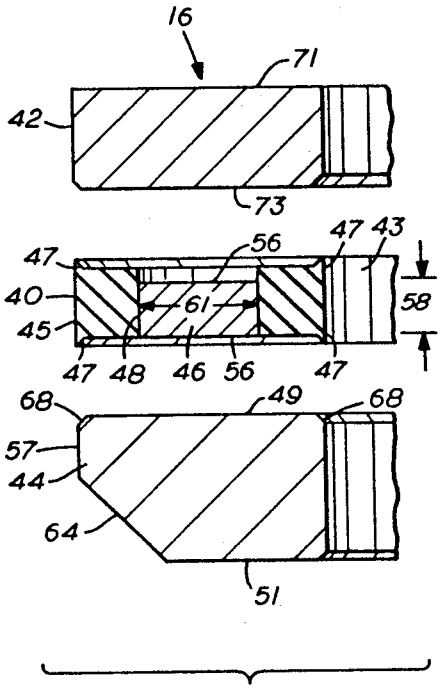
FIG. 4 is an exploded cross-sectional view of the seal assembly used with the improved casing hanger of FIG. 1.
Figure 3:
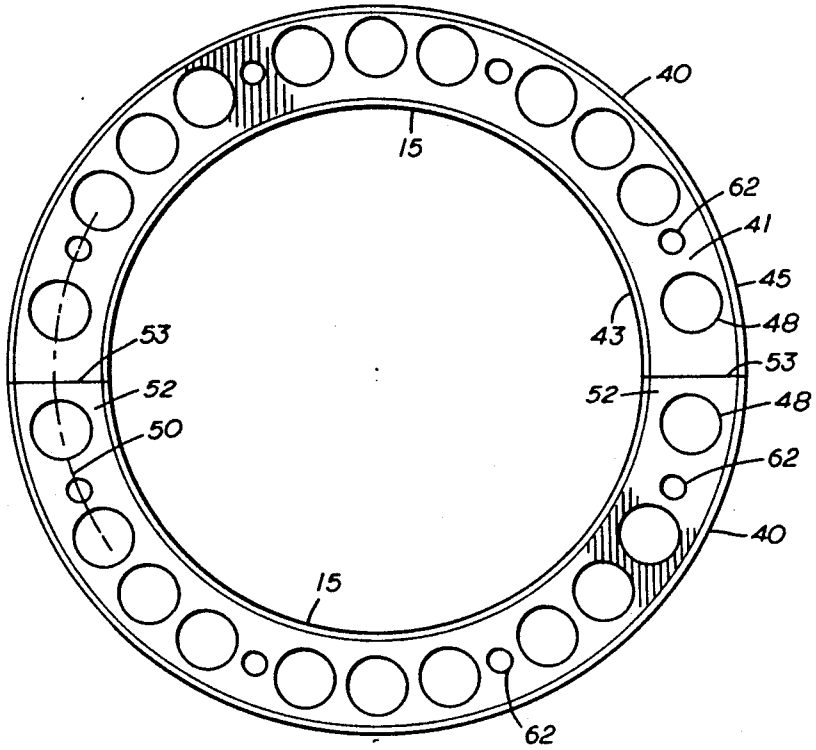
FIG. 3 is a top plan view of the seal element of the improved casing hanger shown in FIG. 1.
Figure 7:
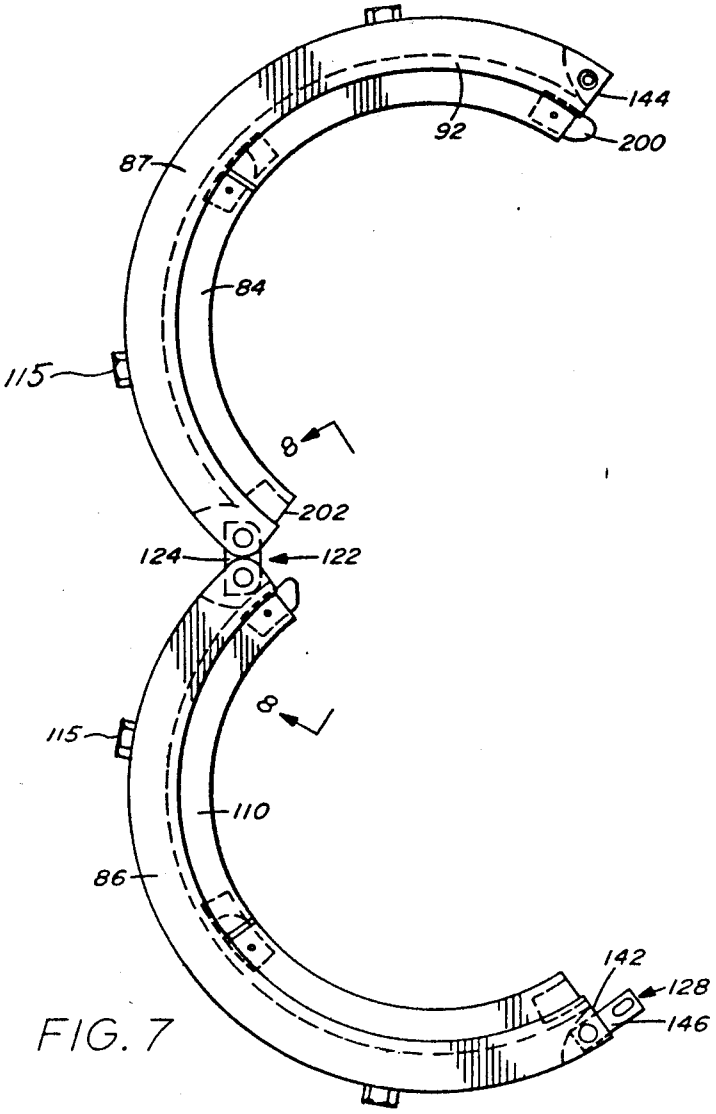
FIG. 7 is a top view of the casing hanger assembly of FIG. 6 shown in an articulated open position.
Figure 6:
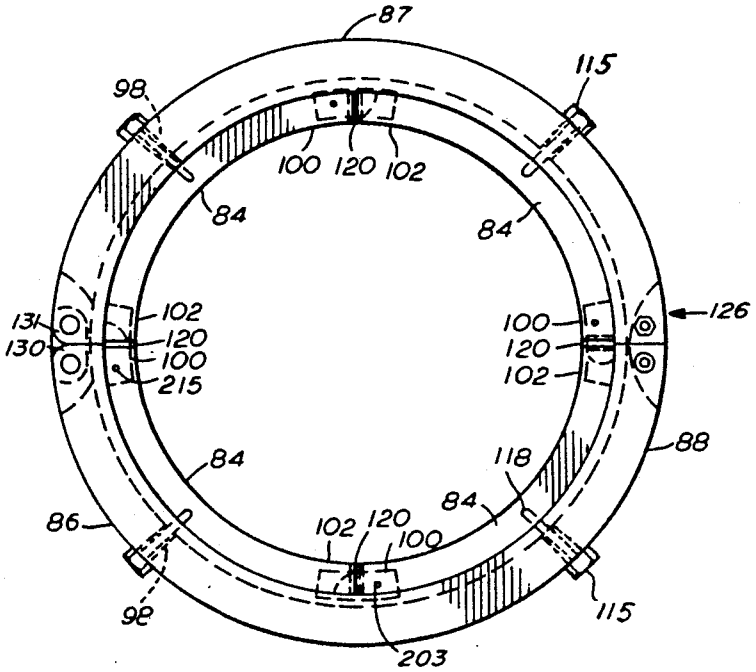
FIG. 6 is a top view of the casing hanger assembly used in the wellhead of FIG. 1.
Figure 8:
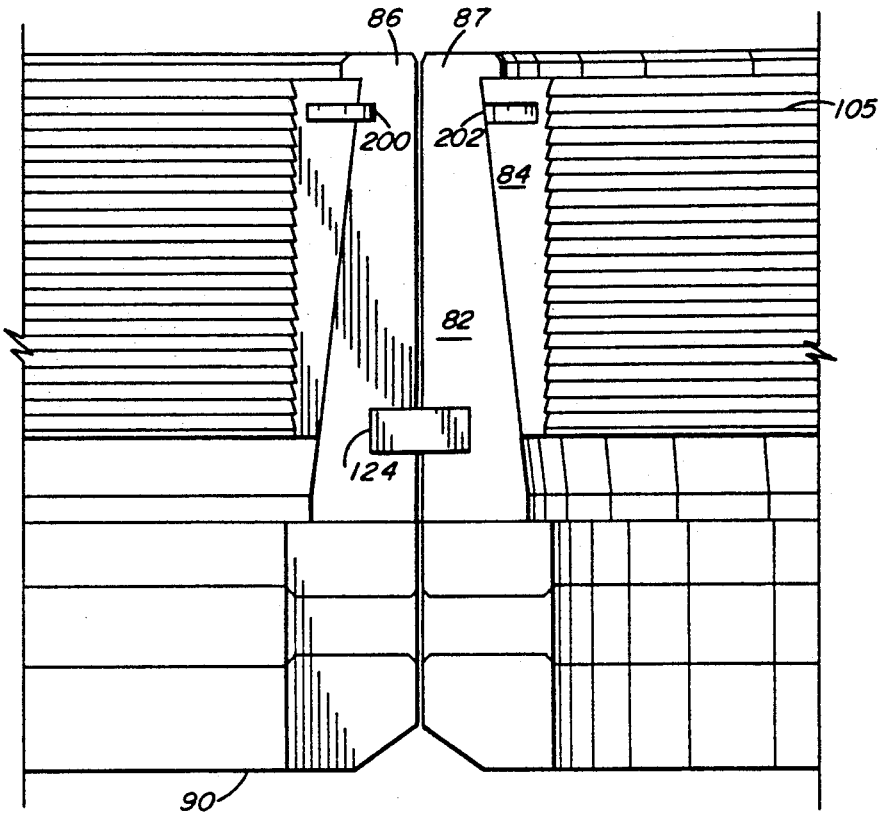
FIG. 8 is a side view of the casing hanger assembly of FIG. 7 looking radially outward from its inner diameter.
Figure 9:
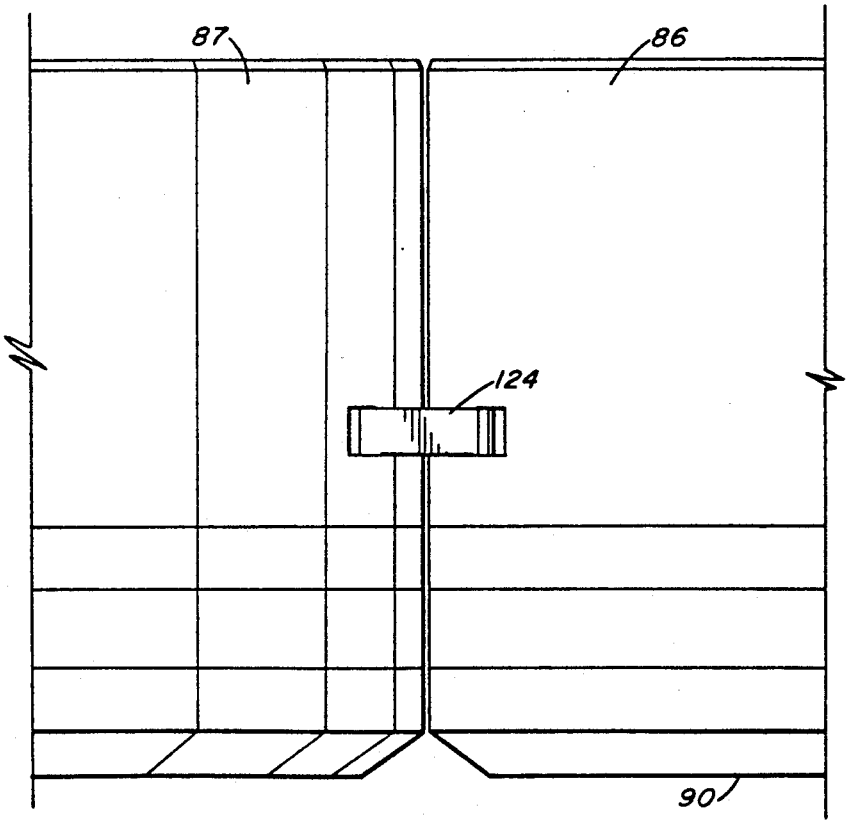
FIG. 9 is a side view of the casing hanger assembly of FIG. 7 looking radially inward from the outside thereof.

Referring now to FIGS. 3, 4, and 5, the seal assembly 16 of the present invention includes an elastomeric seal ring element 40 sandwiched between an upper packing plate 42 and lower retainer plate 44. Elastomeric seal ring element 40 is a specially cross-sectioned member having an annular main body or web portion 41 and inner and outer diametral walls 43, 45. The interface of the angles of the upper plate 42 and lower plate 44 with inner and outer walls 43, 45 forms raised lips 47. Seal ring element 40 is made of an elastomeric compound appropriate to expected service conditions. For example, a rubber such as peroxide cured Buna would be appropriate for some types of routine service. Seal ring element 40 preferably has a durometer hardness of about eighty.

Figure 15:
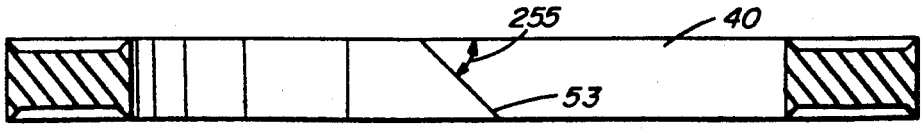
FIG. 15 is an elevation showing the split seal ring element of the present invention.

A plurality of load bearing pedestals 46 are disposed in pedestal apertures 48 located through web portion 41 of seal ring element 40. Pedestal apertures 48 comprise a plurality of circular cylindrical apertures preferably disposed completely through web portion 41 and circumferentially spaced around web portion 41 on bolt circle 50. Bolt circle 50 is disposed at the annular circumference at which substantially equal seal ring element material is disposed on either radial side thereof. Pedestal apertures 48 are preferably circumferentially spaced in groups around seal ring element 40, except at two diametrically opposed aperture gaps 52. At aperture gaps 52, seal ring element 40 is cut through at parting line 53, preferably at an angle as flat as practicable (best shown at 255 in FIG. 15). For some applications, for example, if element 40 were thin and flexible enough, only one cut 53 may be required. A pedestal 46 is disposed in each pedestal aperture. Each pedestal 46 may comprise a right circular cylindrical member having chamfered opposed parallel flat ends 56. The distance between flat ends 56, or pedestal height 58, and the rubber thickness are established by the amount of seal compression required to effect a seal. The diameter 61 of pedestals 46 is sized for a slip fit in apertures 48. Thus, pedestals 46 are retained in seal ring element 40 by the frictional force between the walls of pedestals 46 and pedestal apertures 48. A gap exists between pedestal ends 56 and the outer surface of web portion 41. This allows the pedestals 46 to float or move within the seal element as the seal element expands radially to sealingly engage the casing and head. By permitting the pedestals to float, stress will be evenly distributed across the seal element. Seal ring element 40 further includes a plurality of bolt holes 62, normally eight, disposed between the groups of pedestals 46. Each bolt hole 62 is a through hole disposed in web portion 41 on bolt circle 50

Upper parking plate 42 and lower retainer plate 44 are right annular members formed as single pieces and cut in half to facilitate assembly around casing 20 and into head 12. Lower retainer plate 44 is a generally planar annular member having upper and lower parallel planar faces 49, 51 and a downwardly and outwardly facing frustoconical bearing face 64 between outer radial wall 57 and lower face 51. Bearing face 64 is formed on lower retainer plate 44 to match the contour of retaining shoulder 26 in head 12. The upper face 49 of plate 44 includes chamfers 68 along its inner and outer radial edges machined to match lips 47 on seal ring element 40. A plurality of lower retainer bolt holes 70 are disposed through lower retainer plate 44 between faces 49, 51 and partially through bearing face 64 to colinearly align with seal element bolt holes 62. Lower retainer bolt holes 70 are counterbored, such that their diameters adjacent lower face 51 and bearing face 64 are larger than their diameters adjacent upper face 49. Counterbore 72 is concentrically disposed with respect to each bolt hole 70. Lower retainer plate 44 is split into two equal halves for easy assembly into head 12.

Upper packing plate 42 comprises a right annular split member having opposed parallel upper and lower bearing surfaces 71, 73 and a plurality of bolt holes 69 therethrough between bearing faces 71, 73 in concentric alignment with seal bolt holes 62 when assembled. Lower bearing surface 73 includes chamfers 74 around its inner and outer radial edges which receive seal lips 47 therein. Upper retainer plate 42 is comprised of a pair of semicircular halves. A sandwich of upper retainer plate 42, lower retainer plate 44, and seal ring element 40, including pedestals 46 therein, forms seal assembly 16. Each seal assembly 16 is split into substantially identical seal assembly halves 15.

Referring again to FIGS. 1 and 2, slip and bowl assembly 18 is mounted over seal assembly 16, which is retained in head 12 by interfering engagement of bearing face 64 against shoulder 26. For assembly purposes, seal assembly 16 is mounted to the bowl portion 82 of slip and bowl assembly 18 by a plurality of bolts or cap screws 76 mounted through aligned bolt holes 70 and seal bolt holes 62 and threadingly engaged into the lower portion of the slip and bowl assembly. Bowl portion 82 includes a plurality of threaded bores 75 in lower bearing face 90 in alignment with seal bolt holes 62 when assembled. Bolts or cap screws 76 include an enlarged head portion 78 which is anchored against the shoulder at the upper end of counterbore 72. Thus, seal assembly 16 is mounted to the underside of slip and bowl assembly 18 to facilitate assembly into head 12.

Referring now to FIGS. 1, 2, and 5-9, slip and bowl assembly 18 includes an annular bowl 82 carrying a plurality, preferably four, of slips 84 therein. Slips 84 comprise substantially arcuate sections disposed together end-to-end to form an annulus. Bowl 82 likewise comprises an annulus, having substantially identical first and second bowl halves 86, 87. Each slip quarter-section 84 is substantially identical as well, unless otherwise specified. Slip sections 84 are sized to engage casing 20 and bowl 82 to transfer the weight of casing 20 through bowl 82 and into seal assembly 16 and head 12 to hang and seal casing 20 in the wellbore.

Bowl 82 comprises an annular member formed by bowl halves 86, 87 having an outer radial wall 88, a lower bearing face 90, an upper lip projection 92, and a frustoconical inwardly and upwardly facing slip actuating face 94 forming the inner diametral face of bowl 82. Lip projection 92 extends radially inwardly and overhangs the upper terminus of slip actuating face 94, forming a slip stop 96. Slip stop 96 prevents upward and, therefore, outward movement of the slip sections 84 from bowl 82 during service. A downwardly and outwardly facing frustoconical surface 99 may be formed between lower bearing face 90 and outer radial wall 88 to aid in the placement of bowl 82 in head 12. Each bowl half 86, 87 includes a pair of slip retainer bores 98 in outer radial wall 88 and extending through slip actuating face 94, and spaced apart such that when halves 86, 87 are placed together to form a ring, the bores 98 are spaced apart about ninety degrees.

Slip sections 84 comprise substantially quarter-sections of a complete annulus, each having end faces 100, 102 which are engageable with the end faces of each adjacent slip section as the slip sections 84 actuate downwardly and inwardly upon loading. Slips 84 further include a toothed inner circumferential face 104 and a downwardly and outwardly facing frustoconical slip actuating surface 106 forming the outer circumferential face. Surface 106 is shaped correlatively to face 94 of bowl 82 to align inner face 104 substantially parallel to the wellbore when slips 84 are mounted in bowl 82. Toothed inner face 104 includes pipe gripping teeth 105 which comprise a plurality of circumferentially extending ridges disposed on inner face 104. Slips 84 have a lower flat face 108 between inner face 104 and outer face 106, and an upper face 110. Upper face 110 is substantially flat around its radially inner portion, and has a groove 112 along its outer radial edge which forms an engagement shoulder 114.

To facilitate handling and assembly of slip and bowl assembly 18, slip retainer bores 98 are sized to permit passage of bolts or cap screws 115 from outer radial wall 88 through face 94 of bowl halves 86, 87 into slip segments 84, where the bolts or cap screws are threadingly retained in threaded bores 118 in each slip segment 84. Bores 98, 118 are located such that upon threaded engagement of bolts 115 therethrough into slip segments 84, engagement shoulder 114 abuts the underside of lip 92. Each slip segment 84 is sized such that a gap 120 located between adjacent ends 100, 102 of adjacent slips 84 is at a maximum when slips 84 are fully retained by bolts 115 and engagement shoulder 114 abuts the underside of lip 92. Bolts 115 when tightened hold slip segments 84 apart and in a retracted position away from gripping engagement with the casing 20.

Removal of all of the bolts 115 enables slip segments 84 to collapse onto the casing. As slips 84 actuate downwardly and thus radially inwardly into the bowl 82, for example in response to loosening of bolts 115 and loading by casing 20, gap 120 shrinks. At maximum intended radially inward actuation of slips 84, gap 120 closes and adjacent ends 100, 102 come into contact with one another.

Figure 10:
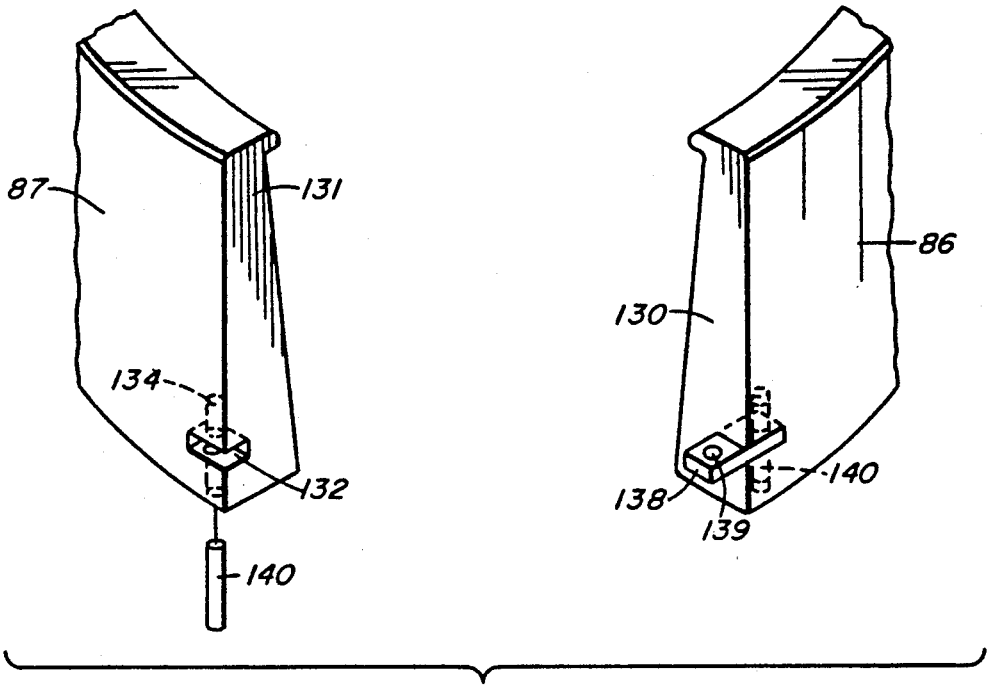
FIG. 10 is a detail view of the hinge assembly of the bowl of the casing hanger of FIG. 1.

Each bowl half 86, 87 includes a hinge portion 122 for receiving a hinge 124, and a latch portion 126 for receiving a latch 128. As best shown in FIG. 10, each hinge portion 122 is located at abutting circumferential ends 130, 131 of bowl halves 86, 87, and includes a circumferentially extending blind slot or undercut 132 in the ends 130, 131 and radially outer wall 88, and a pair of hinge pin bores 134 extending upwardly from the bottom faces of adjacent abutting ends 130, 131. Each pin bore 134 projects upwardly through the bowl halves 86, 87 and into slot or undercut 132. A hinge plate 138, comprising a flat member having a pair of spaced apart holes 139 therethrough, is inserted in slot 132 such that pin bores 134 align with holes 139, and is pinned in place by pins 140 inserted through pin bores 134 and spaced bores 139. Pin bores 134 are sized to receive pins 140 with diametral clearance therebetween. However, pins 140 are received in spaced bores 139 by a press fit. Each half of bowl 82 may articulate about a single pin 140.

Referring to FIG. 11, the opposite abutting ends 142, 144 of the bowl 82 are attached together by a latch 128 which includes a pin mounted latch bar 146 retained at one end in a latch slot 150 in end 142 by a pin 151. The other end 153 of latch bar 146 is disposed in a latch slot 152 in end 144. End 153 of latch bar 146 includes a through bore 154 therein. End 153 passes through latch slot 152 in arcuate fashion as bowl halves 86, 87 are closed into an annulus. A lock pin 155 is received in a through bore in end 144 and in through bore 154 to retain end 153 in latch slot 152 and lock the bowl halves together to form a continuous annular bowl 82.

Figure 14:
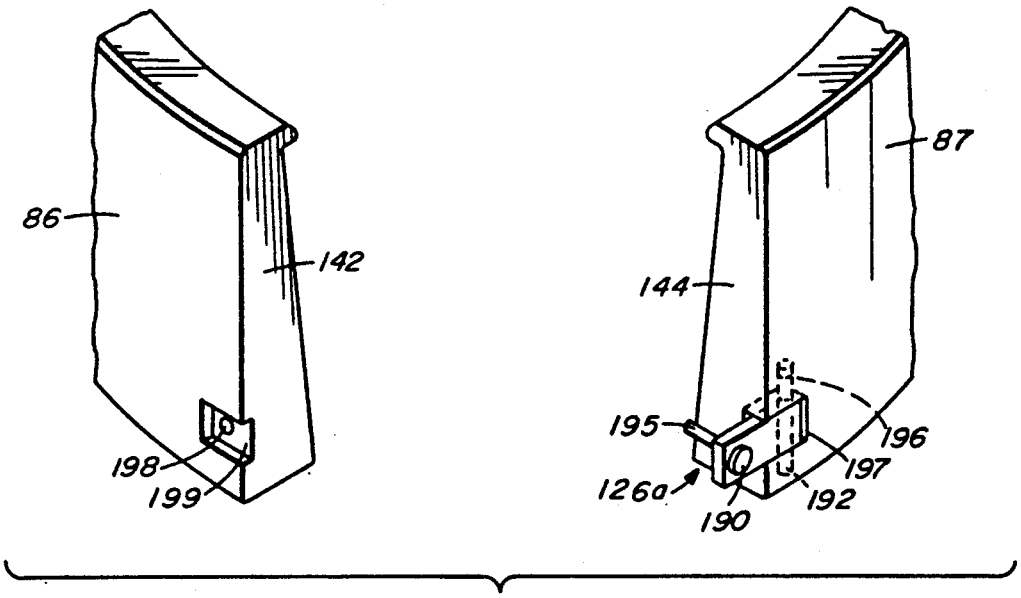
FIG. 14 is a view of an alternative latch configuration for use with the present invention.

Referring to FIG. 14, an alternative latch mechanism **126*a* is shown, and includes a latch bar 190 having one end retained in end 144 by a pin 196 disposed in a transversely extending bore 192 which registers with a transversely extending bore in latch bar 190. A radially extending latch bore is disposed in the other end of latch bar 190. When bowl halves 86, 87 are joined, latch bar 190 is affixed to end 142 of bowl half 86 with a bolt 195 radially disposed in the latch bore in latch bar 190 and in a threaded bore 198 in the outer wall of bowl half 86. One end portion of latch bar 190 projects into a latch slot 197 in end 144 of bowl half 87, and the other end portion is received in a latch slot 199 in end 142 of bowl half 86**.

Referring to FIG. 11, fragmentary portions of slips 84 are shown in bowl 82. To help assure substantially simultaneous engagement of slips 84 along slip actuating face 94 and onto casing 20, a plurality of slip support fingers 200 are disposed between adjacent slip segments 84. Adjacent ends 100, 102 of slip segments 84 include alignment slots 202 in register with one another and projecting into ends 100, 102 parallel to upper face 110. Each slot 202 extends into a slip segment 84 a short way, for example about an inch, from ends 100, 102. A transversely extending bore 203 (FIG. 6) projects into slip segments 84 at one end 100 from upper face 110 through slot 202. Each slip support finger 200 comprises a thin flat member having inner and outer radial side edges 206, 208, a squared profile end 210, and a contoured profile end 212 having an arcuate perimeter between side edges 206, 208 such that inner edge 206 is shorter than outer edge 208. A bore 214 passes through support finger 200 near end 210, and a pin 215 is inserted through bores 203, 214 to retain end 210 in slot 202 in end 100. Support finger 200 is permitted to articulate to a limited extent in slot 202 in end 100 in order to actuate end 212 in and out of slot 202 in end 102.

During assembly of slips 84 into bowl 82, a support finger 200 is mounted in slot 202 in end 100, and is arcuately pushed into slot 202 in adjacent end 102. As slips 84 engage casing 20, each support finger 200 helps actuate the slip segments 84 between which it is disposed equally downwardly in bowl 82, thereby preventing the slip segments 84 from loading unevenly on casing 20. Slip segments 84 do not begin to actuate downwardly until all bolts 115 are removed. Removal of all bolts 115 is required in order to place the hanger of the present invention into the head.

Referring now to FIGS. 12 and 13, an alternative pedestal 220 and seal element 250 are shown, wherein the circular cylindrical pedestals 46 are replaced by a plurality, preferably eight, of arcuate pedestals 220. The pedestals 220 are located in elongated pedestal apertures 252 disposed through seal ring element 40, and are sized to replace, for example, two or three of the circular cylindrical pedestals 46, as shown by comparing FIGS. 3 and 13.

Referring again to FIGS. and 2, the improved casing hanger and seal assembly of the present invention is employed to hang casing 20 in wellhead 14. To assemble the improved casing hanger and seal assembly of the present invention, two slip segments 84 are mounted in each bowl half with bolts 115. A half 15 of seal assembly 16 is attached to the lower bearing face 90 of each bowl half 86, 87 with bolts 76. Bowl halves 86, 87, with seal halves 15 attached thereto, are then hinged together, while support fingers 200 are aligned into slots 202 in slip segments 84. The slip and bowl assembly 18 with attached seal assembly 16 is then wrapped around casing 20 and latched together. Bolts 115 are removed, which frees slips 84 to collapse uniformly in bowl 82. The casing 20 is lowered through the blowout preventer until seal assembly 16 and slip and bowl assembly 18 are disposed within head 12 and lower retainer plate 44 engages shoulder 26. At this point, casing 20 is stretched by pulling it up from the derrick. The force is then incrementally reduced, and slips 84 actuate downward in bowl 82, compressing seal assembly 16 until upper packing plate 44 and lower retainer plate 42 engage pedestals 46. At this point seal element 40 is compressed to its maximum, and expands radially outwardly to engage surface 22 of head 12 and radially inwardly to sealingly engage casing 20. The split seal element 40 with floating stops 46 helps assure positive sealing between casing 20 and head 12. It eliminates uneven loading which could result from a central annular pedestal and separate inner and outer radial seal elements by assuring that loads are distributed evenly in radial directions across the complete cross-section of the seal element. Once the casing 20 is held by slips 84, the force pulling on casing 20 is removed. The casing 20 is thus suspended in the well and sealed with respect to the head.

While preferred and alternative embodiments of the invention have been shown and described, many modifications thereof may be made by those skilled in the art without departing from the spirit of the invention. Therefore, the scope of the invention should be determined in accordance with the following claims.

I claim:

1. A casing hanger and seal apparatus for hanging and sealing a casing string disposed in a head mounted around a wellbore, the head having an internal bore with a load shoulder thereon, comprising:

seal assembly means adapted for landing and seating upon the load shoulder around the casing string, said seal assembly means including seal element means for sealingly engaging the internal bore of the head and the outside surface of the casing string when energized;

slip means disposed on said seal assembly means and adapted for gripping the casing string and energizing the seal element means when actuated; and stop means disposed and floatable within said seal element means for limiting its energization to a predetermined amount.

2. The apparatus of claim 1, wherein said seal element means includes an annular main body portion having a plurality of apertures circumferentially spaced apart therewithin, and said stop means includes a plurality of pedestals disposed in said apertures, said pedestals being slidably movable within said apertures.

3. The apparatus of claim 2, wherein the main body portion of said seal element means has an axial thickness greater than the height of said pedestals.

4. The apparatus of claim 3, wherein said pedestals are frictionally retained in said apertures.

5. The apparatus of claim 3, wherein said pedestals comprise substantially circular cylindrical bodies.

6. The apparatus of claim 3, wherein said pedestals comprise substantially right circular cylindrical bodies.

7. The apparatus of claim 3, wherein said pedestals comprise arcuate bodies having a substantially rectangular cross section.

8. The apparatus of claim 7 or claim 5, wherein said apertures are shaped correlatively to said pedestals.

9. The apparatus of claim 3, wherein the main body portion of said seal element means comprises substantially flat upper and lower annular faces, and said seal element means includes a raised lip disposed around the inner and outer diametral surfaces of said main body portion at said upper and lower faces.

10. The apparatus of claim 9, wherein said raised lips comprise on their sealing surfaces a substantially coplanar extension of the adjacent one of said inner and outer diametral surfaces of said main body portion, and a substantially frustoconical surface on the opposite side of said lips from said sealing surfaces, between said sealing surfaces and the adjacent one of said upper and lower faces.

11. The apparatus of claim 3, wherein said seal element means comprises elastomeric material.

12. The apparatus of claim 11, wherein the volume of elastomeric material of said seal element means radially inwardly of said apertures is substantially the same as the volume of elastomeric material of said seal element means radially outwardly of said apertures.

13. The apparatus of claim 3, wherein said seal assembly means includes an annular retainer plate on which said seal element means is disposed, and an annular packing plate disposed on top of said seal element means, said annular retainer plate including a lower face engageable with the load shoulder of the head for supporting said seal assembly means thereon and an upper face for engaging said seal element means, and said annular packing plate having a lower face for engaging said seal element means and an upper face for engaging and supporting said slip means, said lower face of said upper packing plate being movable toward said upper face of said lower retainer plate for compressing said seal element means therebetween when said upper packing plate is loaded.

14. The apparatus of claim 3, wherein said slip means includes a split annular bowl portion disposed on said seal assembly means and having a tapered inner diametral slip actuating surface, and a plurality of slip segments disposed in said bowl portion, said slip segments each including an inner toothed surface for engaging the casing and an outer tapered surface shaped correlatively to and engaging said tapered inner diametral surface of said bowl portion, said slip segments being actuable radially inwardly into gripping engagement with the casing upon downward movement of said slip segments along said slip actuating surface of said bow portion.

15. The apparatus of claim 14, wherein said bowl portion of said slip means includes a pair of substantially semicircular bowl halves forming an annulus when assembled together, said bowl halves having hinge means disposed on one pair of their abutting ends for connecting said ends together and permitting said bowl halves to articulate about said hinge means.

16. The apparatus of claim 15, wherein the other pair of abutting ends of said bowl halves includes interengageable releasable latch means disposed thereon for releasably latching said other pair of abutting ends together.

17. The apparatus of claim 14, wherein said bowl portion includes a radially inwardly extending slip retaining lip at its upper end portion for engaging said slip segments and retaining said slip segments in said bowl portion.

18. The apparatus of claim 14, wherein said slip segments form a substantially annular structure when assembled end-to-end in said bowl portion, and further including a plurality of retaining bolts disposed through said bowl portion and into said slip segments for retaining said slip segments out of engagement with the casing when said retaining bolts are engaged, and a plurality of slip support fingers disposed between adjacent ends of said slip segments for supporting said slip segments out of engagement with the casing during removal of said retaining bolts and effecting substantially simultaneous engagement of said slip segments with the casing when said retaining bolts are removed.

* * * * *